US005159799A

United States Patent [19]

Rising et al.

[11] Patent Number: 5,159,799

[45] Date of Patent: Nov. 3, 1992

[54] VIAL WITH POWDERED REAGENT

[76] Inventors: Peter E. Rising, 132 Wilbur Pl., Bohemia, N.Y. 11716; Peter G. Chaconas, 11607 Hitching Post La., Rockville, Md. 20852

[21] Appl. No.: 781,875

[22] Filed: Oct. 24, 1991

[51] Int. Cl.[5] ..... B65B 29/06; B65B 31/02; B65B 31/06; B65B 51/20

[52] U.S. Cl. ..... 53/433; 53/440; 53/467; 53/474; 53/477

[58] Field of Search ..... 53/428, 432, 433, 440, 53/445, 474, 467, 477, 453

[56] References Cited

U.S. PATENT DOCUMENTS

| | | | |
|---|---|---|---|
| 2,199,816 | 5/1940 | Flosdorf | 53/428 |
| 2,379,342 | 6/1945 | Cozzoli | 53/440 |
| 2,388,134 | 10/1945 | Flosdorf et al. | 53/432 X |
| 2,552,360 | 5/1951 | Zichis | 53/432 X |
| 3,376,688 | 4/1968 | Takacs et al. | 53/440 X |
| 3,496,695 | 2/1970 | Sickel | 53/432 |
| 3,799,651 | 3/1974 | Janning | 53/432 X |
| 3,899,295 | 8/1975 | Halpern . | |
| 4,471,055 | 9/1984 | Opp . | |
| 4,554,133 | 11/1985 | Leichnitz . | |
| 4,624,929 | 11/1986 | Ullman . | |
| 4,785,608 | 11/1988 | Debnam, Jr. et al. | 53/433 X |
| 4,844,867 | 7/1989 | Bäther . | |
| 4,954,318 | 9/1990 | Yafuso et al. . | |
| 5,004,585 | 4/1991 | Bommer . | |

*Primary Examiner*—Horace M. Culver
*Attorney, Agent, or Firm*—Leonard Belkin

[57] ABSTRACT

A sealed indicator vial to detect the presence of a predetermined contaminant in water containing a mixture of reagents reactive in the presence of water, the mixture being sufficiently dehydrated to prevent the reaction of said reagents while sealed in said vial. The vial contains an inert atmosphere at less than atmospheric pressure. Also described is the method of producing such an indicator vial in which a tube containing the dehydrated reagents is heated and stretched to form a narrow waist while under vacuum.

4 Claims, 3 Drawing Sheets

VIAL WITH POWDERED REAGENT

BACKGROUND OF THE INVENTION

This invention relates to sample collection and more particularly to a sample collection vial and its method of preparation.

The use of sample collection vials for testing the condition of water and other liquids is old in this art. Such vials usually are provided with a liquid reagent selected for the particular application and the interior of the vial may be under a negative pressure to facilitate the collection of the sample in a single step, avoiding the use of an intermediate step which runs the risk of introducing some contamination during the collection process.

Concern with the environment and other considerations have moved industry in the direction of testing for more contaminants some of which are present in smaller and smaller concentrations, and in many cases requiring more sophisticated testing procedures.

For example, in the test for the presence of the element molybdenium in water using the mercaptoacetic acid colorimetric method, the currently available reagent systems provide for a multi step addition of two to three reagents after sample extraction and before the color development and comparison to color standards is made. The procedure takes approximately 15–20 minutes per test and the various steps involved increase the risk that the test can be flawed by foreign matter.

Increased emphasis in testing of water and other liquids for the presence of more contaminants in smaller amounts has produced heightened interest in testing procedures and ways of reducing the risk of questionable results.

A number of U.S. Patents show a variety of testing or sample systems.

U.S. Pat. No. 3,899,295 discloses a system for indicating the integrity of a sealed package.

U.S. Pat. No. 4,471,055 shows an ampule with a liquid reactant in an inert (nitrogen) atmosphere.

U.S. Pat. No. 4,554,133 describes a test tube containing a reagent strip and granular fill material.

U.S. Pat. No. 4,624,929 discloses a sample collector containing a paper strip.

U.S. Pat. No. 4,844,867 describes a colorimetric detector containing a strip-like carrier and also a buffer chamber with a filling.

U.S. Pat. No. 4,954,318 shows an optical sensor using a sensing element connected to an optical fiber.

U.S. Pat. No. 5,004,585 discloses a colorimetric detector tube containing pretreatment regions and indicator regions with granular materials.

None of the preceding patents teaches the present invention.

SUMMARY OF THE INVENTION

The present invention concerns a vacuum vial containing ultra pure especially prepared and substantially anhydrous premixed powders which are stored in the vial ready for use for an indefinite period of time.

The new vacuum vial permits totally dehydrated powders to be premixed on a non reactive basis and be stored under an evacuated and inert gaseous environment for an indefinite period of time. The operator merely breaks the tip of the vial under sample water and the tube is filled automatically. The tube is shaken several times and the color comparison is made. This method saves the operator approximately 10–15 minutes (66%–75%) per test. Additionally, the test requires no adjunct glassware, so the chance of operator introduced contaminants is eliminated.

Important to this product is the very special way that the substantially anhydrous chemical components are maintained in that state during manufacture of the vacuum vial. If not properly sequenced and time controlled to ambient conditions the chemical components will rehydrate and the combined reagents will not work properly.

This unique reagent packaging is applicable to a multitude of different elemental tests in water and may have application in the future for gaseous elements as well.

This invention provides in one embodiment an ampule or vial under partial vacuum containing a highly purified mixture of powdered reagents.

Another embodiment of this invention relates to the method of producing an evacuated vial containing a highly purified mixture of powdered reagents. In this embodiment, measured amounts of the highly purified granular reagents are measured out in a glove box into elongated test tubes and closed with stoppers, the tubes are then transferred to a rotatable platform where the stoppers are replaced by hoses connected to a vacuum source. While maintaining the interior of the tubes under vacuum, the tubes are heated, stretched, narrowed and sealed using a glass blowing technique, forming the sealed ampule or vial which is evacuated and contains the measured amount of a mixture of highly purified substantially anhydrous powdered reagents.

This invention is particularly advantageous for testing the presence of the element molybdenium in water utilizing a sealed vial or ampule containing a substantially anhydrous mixture of powdered sodium sulfate, succinic acid, and calcium thioglycoliate in an inert gaseous environment at subatmospheric pressure.

It is thus a principal object of this invention to provide a vial or an ampule and a method of preparing a vial or an ampule which is evacuated and contains highly purified powdered reagents.

Other objects and advantages of this invention will hereafter become obvious from the following description of preferred embodiments of this invention.

DESCRIPTION OF THE PREFERRED EMBODIMENTS

Figure 1:
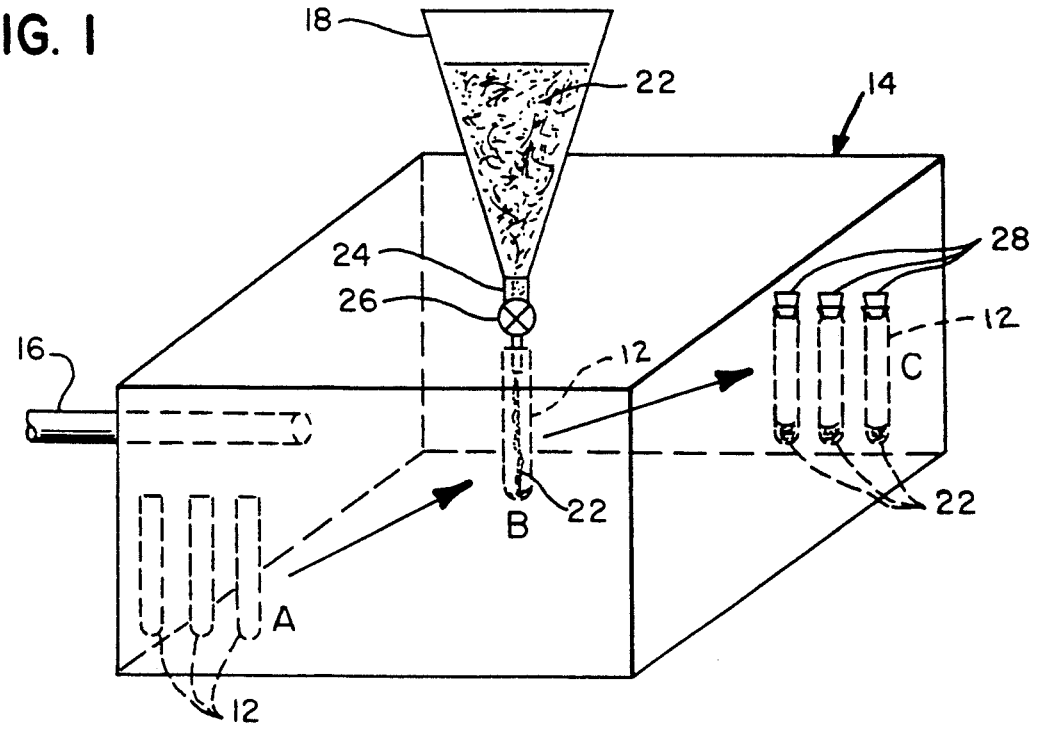
FIG. 1 is a diagrammatic, schematized view of a glove box in which elongated test tubes are supplied with reagent.

Referring to FIG. 1, clean open test tubes 12 are placed inside of a glove box 14 containing an inert gaseous medium such as nitrogen gas supplied by and maintained at an overpressure through a hose 16.

Mounted on glove box 14 is a sealed funnel herein referred to as retention vessel 18 containing a previously prepared highly purified mixture 22 of substantially anhydrous powdered reagents having an outlet tube 24 extending into glove box 14. Within glove box 14, tube 24 is provided with a stopcock 26, which, as is understood in the art, each rotation thereof would release a predetermined measured amount of mixture 22 into the open mouth vial 12 directly underneath.

Figure 1A:
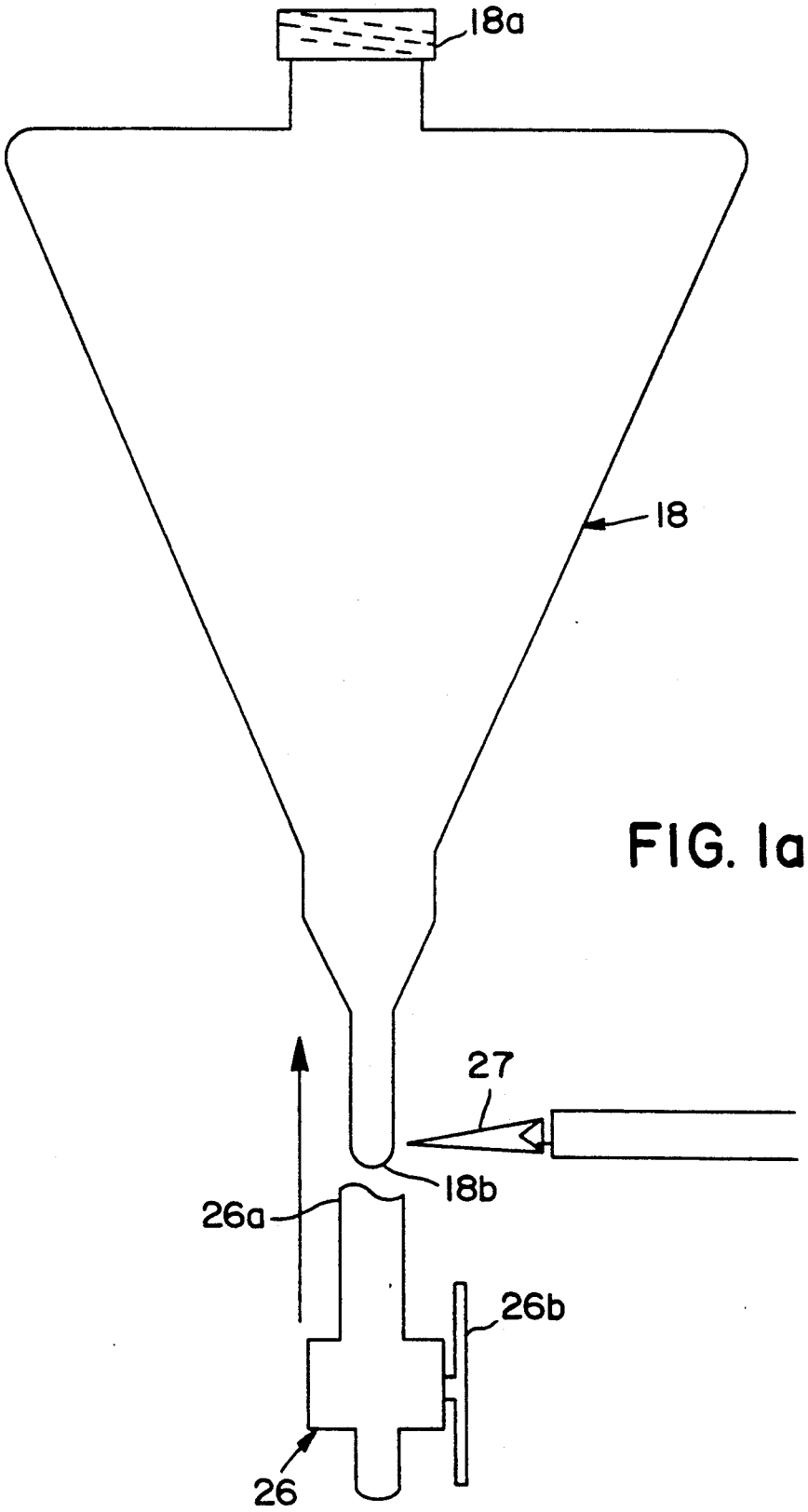
FIG. 1*a* is a diagrammatic view of the retention vessel employed.
Figure 2:
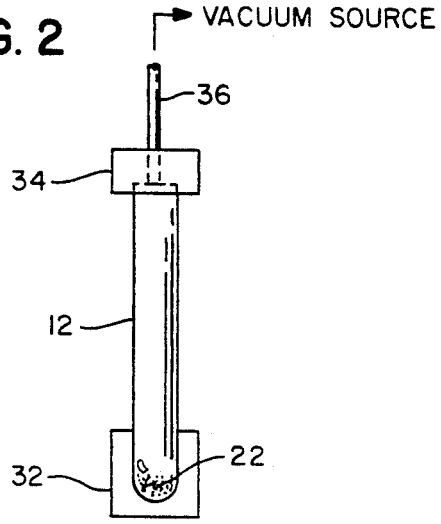
FIGS. 2–6 are diagrammatic views of the steps involved in sealing the load filled vial under vacuum.

For details of retention vessel 18, reference is made to FIG. 1*a* showing vessel 18 made of glass having a threaded cap 18*a* and sealed tip 18*b* at the bottom. Vessel 18 is filled with the proper mixture 22 of the anhydrous powdered reagents by removing cap 18*a*, filling the interior with nitrogen, adding mixture 22, and then closing cap 18*a*. A wax seal is put over cap 18*a*. The mixture 22 may be stored in vessel 18 ready for use for months at a time.

When it is desired to transfer mixture 22 through stopcock into test tube 12, stopcock 26 with a fitting 26*a* is raised to a point under tip 18*b*. A jet of flame 27 is used to melt tip 18*b* and anneal fitting 26*a* to the open tip 18*b*, making vessel 18 ready to dispense mixture 22 in glove box 14. Stopcock 26 is provided with a rotatable member 26*a* which as is understood in the art will pass through a predetermined volume of said mixture for each rotation of member 26*b*.

As is understood in the art, the worker would reach into glove box 14 using gloves (not shown) to fill a number of vials 12 with the measured amount of mixture 22 of the reagents, followed by closing off each vial 12 with a stopper 28. A vial 12 in position A would be moved to position B directly underneath tube 24, filled with mixture 22, then stoppered and moved to position C.

A number of vials 12 closed off with mixture 22 contained therein are removed from glove box 14 and handled in a manner to be described.

Referring to FIGS. 2-6, each vial 12 containing mixture 22 is placed upright with its bottom inserted for support in a hollow closely fitted base 32. Stopper 28 is removed and immediately replaced by a cap 34 which seals and grasps the top, and is attached to a vacuum hose 36 connected to a suction pump (not shown) or other source of vacuum to evacuate the interior of vial 12 leaving only nitrogen under less than atmospheric pressure.

Figure 3:
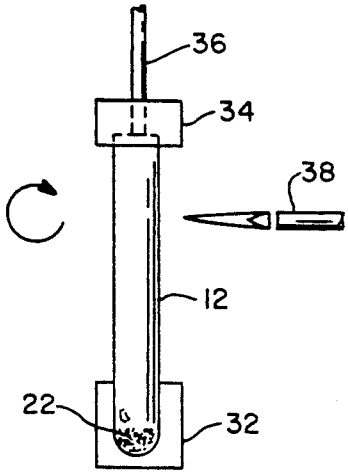
Figure 4:
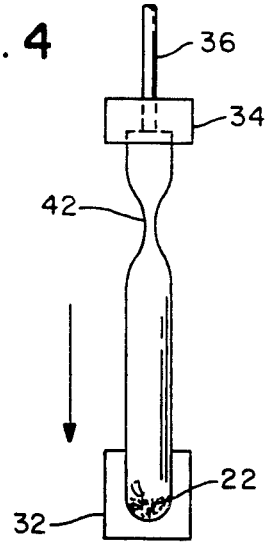

As seen in FIG. 3 a flame nozzle 38 jets a flame to make contact with an intermediate portion of vial 12 while base 32 is rotated to cause vial 12 to spin so that it is heated uniformly around the circumference. After the glass is softened in the region heated, as seen in FIG. 4, cap 34 is pulled upwardly to stretch vial 12. Heat is controlled carefully to insure that the glass is softened only enough to permit the elongation. The softened portion under the influence of the vacuum is drawn inwardly to form a narrow waist 42.

Figure 5:
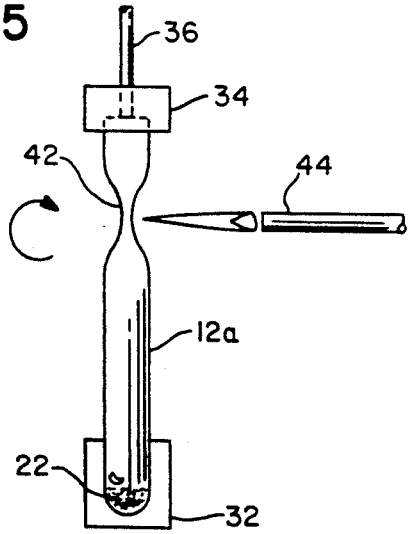
Figure 6:
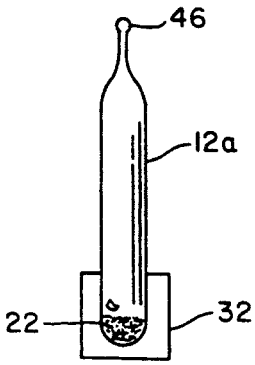

In the next step, seen in FIG. 5, a flame nozzle 44 is employed to heat a very narrow portion of waist 42 until total collapse takes place sealing off the bottom portion 12*a* of vial terminating in a sealed tip 46. Cap 34 with the top portion of vial 12 is removed. Vial 12*a* containing powdered reagent mixture 22 under vacuum is then removed from base 32 and may be otherwise prepared for use, i.e., labelling, scoring of the tip, etc.

The result of the preceding steps is a sealed vial or ampule 12*a* containing an inert gaseous medium such as nitrogen under a subatmospheric pressure and a substantially anhydrous mixture of the powdered reagents.

Figure 7:
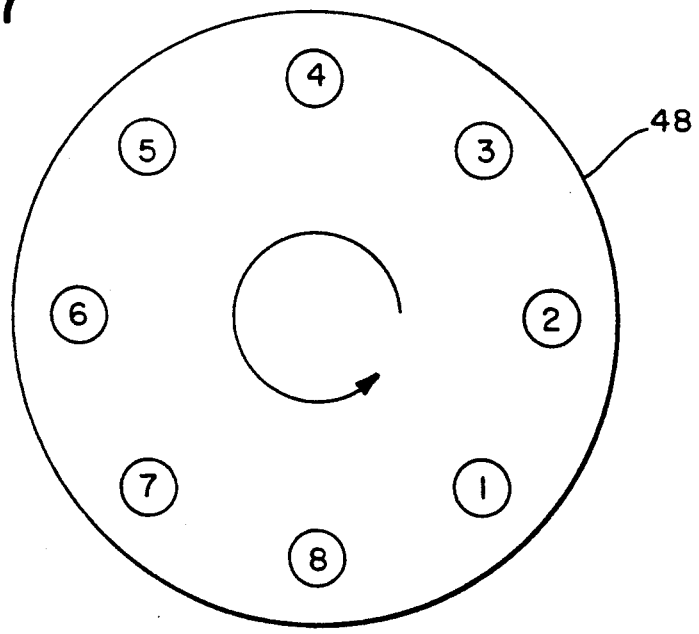
FIG. 7 is a schematized view of one manner for carrying out the steps illustrated in FIGS. 2–6.

The steps of the method described, especially that shown in FIGS. 2-6 can be automated. As seen in FIG. 7, there is provided a rotatable base 48 with eight stations, numbered 1-8. In station 1, a freshly loaded vial 12 from glove box 14 is mounted. Platform 48 is rotated in the direction shown by the arrow so that vial 12 is moved to station 2 where the vial rests while a fresh vial is place on station 1. Platform 48 is rotated so that the first vial is moved to station 3 where the vial is heated and rotated to produce the narrow waist. In station 4, the vial is pulled as seen in FIG. 4. In station 5, the first vial is rested, permitting cooling. In station 6, the waist is heated once again in a very narrow region and the cap pulled further to permit the waist to collapse to form the seal and separate the top of the vial from the bottom. In station 7 the vial rests, and in station 8 the vial 12*a* is removed. In station 1 a new vial is mounted at each rotation of platform 48 and each vial is treated as described at each station so that all of the steps described are occurring at the same time to successive vials.

In this manner, the process is automated to produce a continuous stream of sealed vials or ampules containing powdered reagent under a vacuum.

In the example described above, i.e., testing water for molybdenium, in accordance with the principles of this invention, substantially anhydrous pure sodium sulfate, succinic acid, and calcium thioglycoliate in proper proportions are compounded together using a mortar and pestle under a fume hood to produce the powdered mixture which is employed in the sealed funnel 18 previously described from which measured amounts are dropped into the vials.

As noted earlier, a color comparison is made to determine how much molybdenium is present in the water sample. The color chart being utilized would, as is understood in the art, be prepared from known samples of water with molybdenium based upon a fixed vial or ampule size and standardized mixture of reagents, pressure within the vial, etc.

It is thus seen there has been provided a vial containing premixed powdered reagents which can be stored ready for use for an indefinite period of time.

There has also been provided a method for producing such a vial which is simple, economic, and reliable.

While only certain preferred embodiments of this invention have been described it is understood that many embodiments are possible without departing from the principles of this invention as defined in the claims which follow.

What is claimed is:

1. A method of making an indicator vial for detecting the presence of a predetermined contaminant in a liquid containing a mixture of powdered reagents which become reactive in the presence of said liquid to detect said contaminant comprising the steps of dehydrating said reagents and compounding them together in an inert atmosphere to form said mixture in a retention vessel, transferring a measured amount of said mixture to a tube in the presence of an inert gaseous medium at a pressure above atmospheric, capping said tube with means for producing a vacuum within said tube, heating an intermediate portion of said tube to permit a portion of said tube to partially collapse under said vacuum to form a narrow waist, pinching off said waist to seal the bottom portion of said tube containing said mixture forming said indicator vial, and removing the upper portion of said tube connected to said vacuum producing means leaving a vial containing an inert gas under a partial vacuum and a mixture of substantially anhydrous reagents which will react together in the presence of said liquid.

2. The method of claim 1 wherein said liquid is water.

3. The method of claim 2 wherein said contaminant is molybdenium and said reagents are sodium sulfate, succinic acid, and calcium thioglycoliate.

4. The method of claim 2 in which said retention vessel is made of glass and is shaped in the form of a funnel having a glass sealed tip at the bottom thereof, bringing a stopcock measuring device having a fitting adjacent said sealed tip, said stopcock having a rotatable member to dispense a measured amount of material at each rotation, applying a flame to open said sealed tip and annealing said fitting to the open tip of said vessel, and transferring said measured amount through said stopcock.

* * * * *